US007704434B2

(12) United States Patent
Johnson

(10) Patent No.: US 7,704,434 B2
(45) Date of Patent: Apr. 27, 2010

(54) CONCRETE BLOCK WITH BEVELED CORE OPENING EDGE

(75) Inventor: Jay J. Johnson, Star Prairie, WI (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 927 days.

(21) Appl. No.: 11/147,680

(22) Filed: Jun. 7, 2005

(65) Prior Publication Data

US 2006/0273492 A1 Dec. 7, 2006

(51) Int. Cl.
*B28B 3/00* (2006.01)

(52) U.S. Cl. ..... 264/333; 264/31; 264/32; 264/33; 264/34; 264/35; 264/138; 264/154; 264/155; 264/163; 425/299

(58) Field of Classification Search ..... 264/333, 264/138, 154, 155, 163, 31–35; 425/299
See application file for complete search history.

(56) References Cited

U.S. PATENT DOCUMENTS

| | | | | |
|---|---|---|---|---|
| 1,598,665 | A * | 9/1926 | Urban | 249/146 |
| 2,566,787 | A | 9/1951 | Zevely | |
| 2,780,181 | A * | 2/1957 | Roman et al. | 425/299 |
| 4,123,034 | A * | 10/1978 | Crunk et al. | 249/156 |
| 4,218,206 | A | 8/1980 | Mullins | |
| 4,545,754 | A | 10/1985 | Scheidt | |
| 5,062,610 | A * | 11/1991 | Woolford et al. | 249/52 |
| 5,249,950 | A | 10/1993 | Woolford | |
| 2003/0126821 | A1 | 7/2003 | Scherer | |

FOREIGN PATENT DOCUMENTS

| | | | |
|---|---|---|---|
| EP | 0 175 038 | A1 | 3/1986 |
| EP | 0 319 972 | A2 | 6/1989 |
| EP | 0 670 206 | A1 | 9/1995 |
| JP | 2001 047425 | A | 2/2001 |
| WO | 03/060251 | | 7/2003 |

OTHER PUBLICATIONS

European Search Report, mailed Jun. 12, 2008.
Besser Parts & Equipment Catalog, p. 5 (2 pgs.).
Besser Manual No. 8601—Section 5, *Concrete Paving Stones*.

* cited by examiner

*Primary Examiner*—Christina Johnson
*Assistant Examiner*—Magali P Théodore
(74) *Attorney, Agent, or Firm*—Merchant & Gould P.C.

(57) ABSTRACT

Methods and equipment for forming beveled edge(s) around the core opening in a concrete block are disclosed. The formation of the beveled edge(s) minimizes feathering along the block edges that are beveled as the block is stripped from a mold. Any feathering that does occur is shifted away from the bottom surface of the block to allow the block to lay flat on other blocks when dry stacked in a wall.

5 Claims, 5 Drawing Sheets

FIG. 1
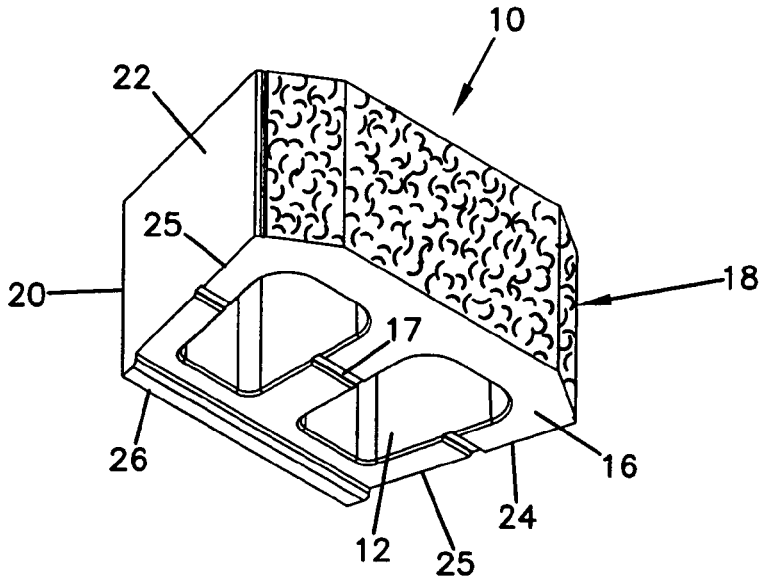
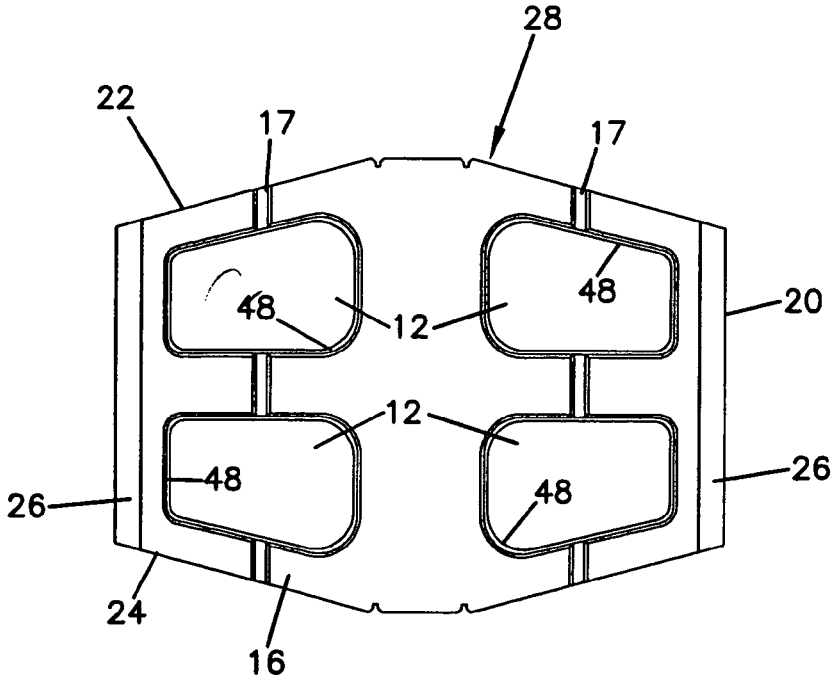
FIG. 2

CONCRETE BLOCK WITH BEVELED CORE OPENING EDGE

FIELD OF THE INVENTION

The invention relates generally to concrete blocks and methods of forming the same. More specifically, the invention relates to concrete blocks having core openings with beveled edges and methods and equipment for forming the beveled edges of the core openings.

BACKGROUND OF THE INVENTION

Concrete blocks have been a basic building material for many years. Concrete blocks have been designed for use in many applications, including concrete retaining wall blocks used to construct retaining walls. Concrete retaining wall blocks are typically dry stacked (i.e. no mortar is used) in ascending courses.

A concrete block is sometimes formed with one or more core openings. This lightens the block thereby make the manual handling of the block easier, and reduces the amount of material used to form the block thereby reducing material costs. The core opening(s) can extend entirely through the block from the top of the block to the bottom, or partially through the block (e.g. extending from the bottom of the block toward the top but not extending through the top).

An example of the formation of core openings in a concrete retaining wall block is disclosed in U.S. Pat. No. 5,827,015. As disclosed in that patent, and with reference to FIG. 6 herein, a pair of concrete retaining wall blocks are formed face-to-face within a mold 100 that has an open top and an open bottom and is positioned on a pallet 102. The tops of the resulting blocks rest on the pallet and the bottom of the blocks face upward. For each block, a pair of core forms 104 are positioned within the mold 100 to form a pair of core openings in each of the resulting blocks. Dry-cast concrete is then deposited in the mold 100, the mold is vibrated to densify the dry-cast concrete, and a head 106 or "stripper-shoe" is brought down into the mold to compress the concrete in the mold and form the resulting bottom surfaces of the blocks. Thereafter, the blocks are stripped from the mold through relative vertical movement of the pallet 102 and mold 100 assisted by the head 106 pushing the blocks out of the mold. As the blocks are stripped from the mold, the core forms 104, which are fixed to the mold, strip from the concrete, leaving behind the core openings in the blocks.

When a cored retaining wall block is stripped from the mold, a small ridge of concrete tends to be left around the edge of the core opening at what will be the bottom surface of the block (termed "feathering"). Similar feathering tends to occur along other edges of what will be the bottom surface of the block that are in contact with mold surfaces, for example the bottom side edges of the block. Once solidified, feathering can interfere with the block laying flat on other blocks when dry-stacked in a wall.

Attempts to remove the feathering have included the use of a rotating brush on the production line after the block is stripped from the mold to sweep away feathering that occurs. However, it has been found that the brush often leaves some of the feathering, particularly feathering that occurs along an edge that is perpendicular to the rotational axis of the brush.

There is a need for methods and equipment that minimize the feathering that occurs along bottom edges on concrete blocks as a result of the blocks being stripped from the mold.

SUMMARY OF THE INVENTION

The invention relates to a concrete block having at least one core opening with one or more beveled edges. The invention also relates to methods and equipment for forming the beveled edge(s) around the core opening. The formation of the beveled edge(s) eliminates the impact of feathering by reducing the amount of feathering that occurs and shifts any feathering that does occur away from the bottom surface so that the feathering does not prevent the block from laying flat on other blocks.

Any number of the core opening edges can be beveled as described herein. Only those edges of the core opening that tend to have residual feathering after passing by a rotating brush, for example edges of the core opening that are perpendicular to the rotational axis of the brush, may be beveled. Alternatively, all of the edges of the core opening may be beveled as described herein.

Similar beveling can be provided on the edges of the block at the intersection of the bottom surface of the block and the sides of the block to reduce feathering at the bottom side edges of the block and shift any feathering that does occur away from the bottom surface.

In one aspect of the invention, a stripper shoe is provided for use in forming a concrete block in a block mold. The stripper shoe is in the form of a plate having a first surface that in use faces the concrete block in the block mold. At least one core form opening is formed in the plate, where the core form opening is configured to allow passage therethrough of a core form that is used to form the core opening in the concrete block. In addition, a beveled ridge is formed on the first surface of the plate along at least a portion of the core form opening and projecting from the first surface toward the concrete block. The beveled ridge forms the beveled edge around the core opening.

In another aspect of the invention, a method of forming a core opening in a concrete block molded in a block mold is provided. In the method, during molding of the block and formation of the core opening, a beveled edge is molded around at least a portion of the perimeter of the core opening.

In yet another aspect of the invention, a method of forming at least one core opening in a concrete block is provided. The method includes providing a block mold having a plurality of side walls defining a mold cavity with an open top and an open bottom; positioning a pallet underneath the block mold to temporarily close the open bottom of the mold cavity; positioning a core form in the mold cavity at a location to form the core opening; depositing dry-cast concrete in the mold cavity; introducing a plate through the open top of the mold cavity to compact the dry-cast concrete in the mold cavity to form a pre-cured concrete block, the plate having a first surface that in use faces the mold cavity, the plate having a core form opening formed therein that is configured to allow passage therethrough of the core form, and the plate having a beveled ridge formed on the first surface of the plate along at least a portion of the core form opening and projecting from the first surface toward the mold cavity; reopening the temporarily-closed bottom of the mold cavity; discharging the pre-cured concrete block from the mold cavity through the reopened bottom of the mod cavity; and curing the pre-cured concrete block.

BRIEF DESCRIPTION OF THE DRAWINGS

FIG. 1 is a bottom perspective view of a concrete block with core openings having beveled edges according to the invention.

FIG. 2 is a top view of a pre-split concrete workpiece comprising two concrete blocks molded face-to-face and oriented bottom-sides up.

DETAILED DESCRIPTION OF THE PREFERRED EMBODIMENT

Figure 3:
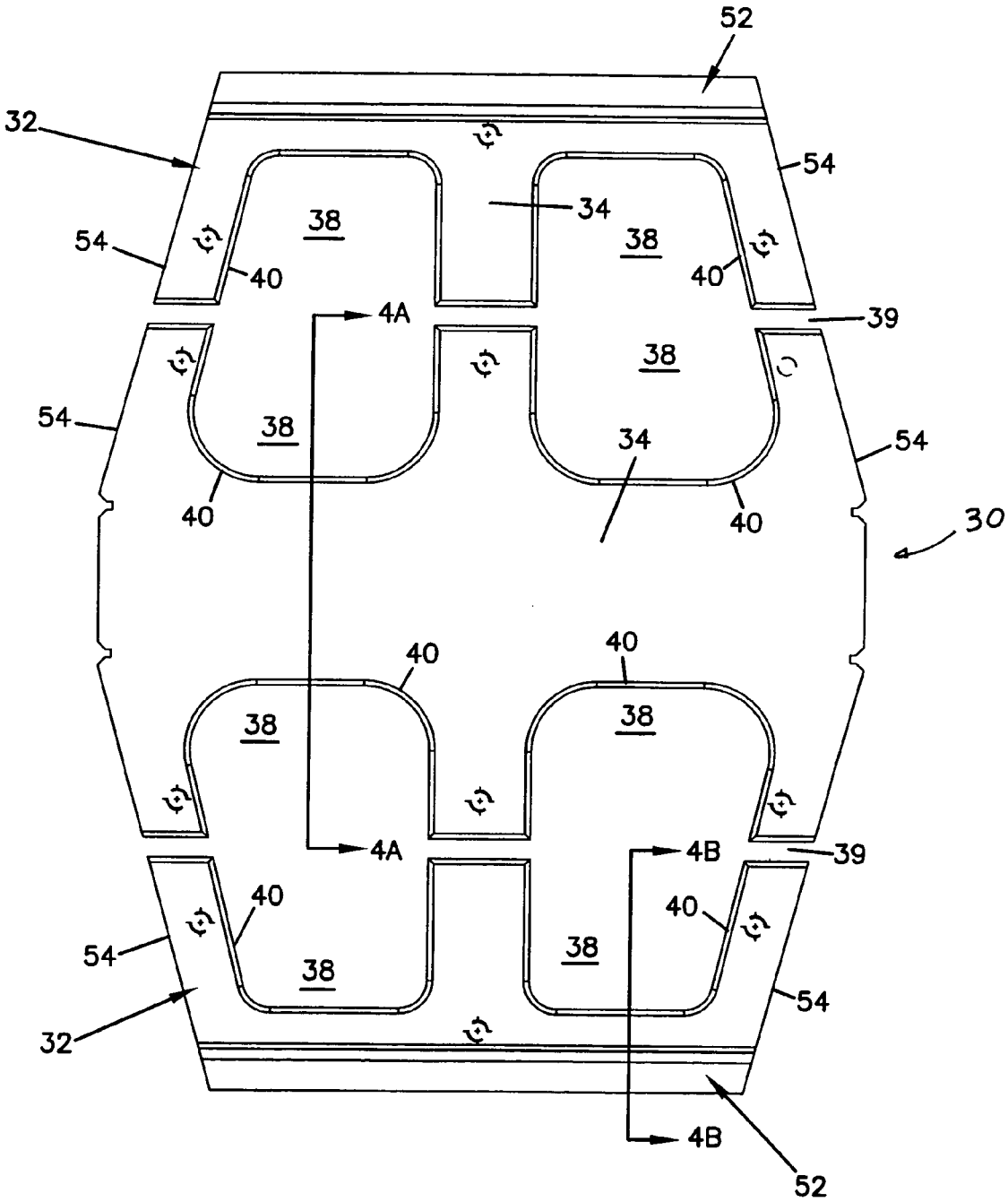
FIG. 3 is a bottom view of a center stripper shoe and a pair of outside stripper shoes that are used to compact the concrete in the mold cavity and mold the top side of the work piece of FIG. 2 (i.e. the bottoms of the resulting blocks).

The invention relates to a concrete block 10 having at least one core opening 12 with one or more beveled edges 48. The invention also relates to methods and equipment for forming the beveled edge(s) 48 around the core opening 12. A stripper shoe is configured to form the beveled edge 48 during molding of the block 10. The bevel helps to minimize a ridge of concrete (i.e. feathering) that tends to be left around the edge of the core opening once the block is stripped from the mold. Further, any feathering that is left is below the bottom surface of the block so that the block is more likely to lay flat when stacked into courses with other like blocks.

The block 10 will be described herein as having a pair of core openings 12. However, the block could have a larger or smaller number of core openings. Further, the core openings 12 of the block 10 will be described herein as extending completely through the block from the bottom surface to the top surface. However, other arrangements of the core openings 12 are also possible. For example, the core openings 12 need not extend completely through the block; instead the core openings 12 could extend upwardly from the bottom surface toward the top surface, but stop short of the top surface so that the core openings do not extend through the top surface.

FIG. 1 illustrates the concrete block 10 having a pair of core openings 12 that extend completely through the block 10 from the bottom surface 16 of the block 10 to the top surface (not visible). The illustrated block 10 also includes a front surface 18, a rear surface 20, and side surfaces 22, 24 that extend from the front surface 18 to the rear surface 20 and that converge toward each other as the side surfaces approach the rear surface 20. The bottom surface 16 is also provided with a locator flange 26 that projects from the bottom surface 16 adjacent the rear surface 20 of the block. A block of this configuration is the Anchor Diamond Pro™ block available from Anchor Block Company, Inc. of Minnetonka, Minn.

The front surface 18 of the block is provided with a rough texture resulting from, for example, a splitting process on a concrete workpiece 28, shown in FIG. 2, comprising a pair of the blocks 10 formed face-to-face. The formation of concrete blocks by splitting a concrete workpiece is disclosed, for example, in U.S. Pat. No. 5,827,015 which is incorporated by reference herein in its entirety.

As disclosed in more detail in U.S. Pat. No. 5,827,015, and with reference to FIG. 6 herein, the work piece is formed within a mold 100 having a plurality of side walls 108 defining a mold cavity 110 with an open top and an open bottom. A pallet 102 is positioned underneath the mold 100 to temporarily close the open bottom of the mold cavity. In addition, core forms 104 are fixed to core bars 112 that are connected to the mold so that the core forms 104 are positioned within the mold cavity 110 to form the core openings. Dry-cast concrete is then deposited into the mold cavity, and is compacted to densify it.

Figure 6:
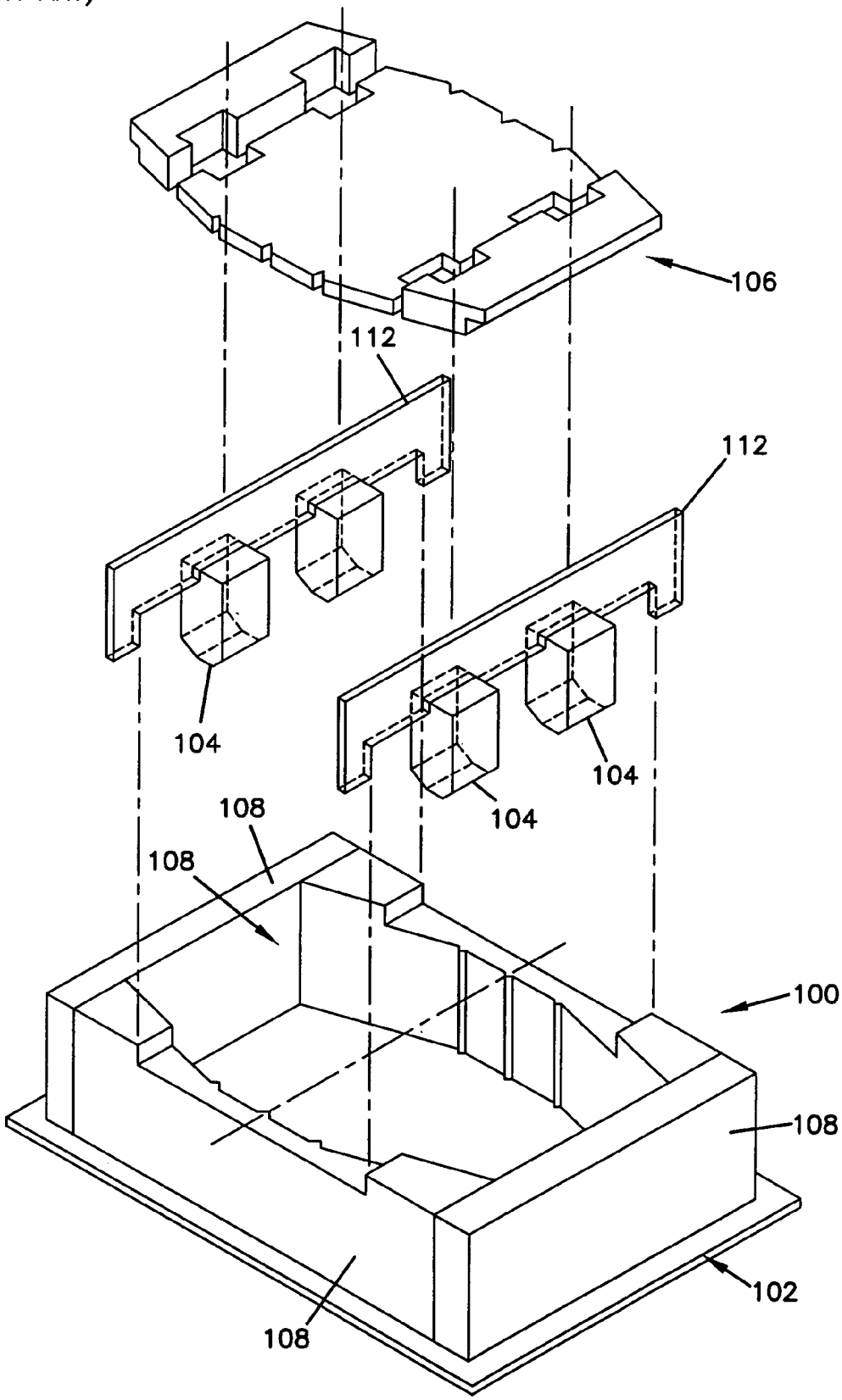
FIG. 6 (PRIOR ART)
FIG. 6 is an exploded perspective view of a prior art embodiment of a concrete block mold along with core support bars, core forms, outside stripper shoes and a center stripper shoe.

Densification is accomplished primarily through vibration of the dry cast concrete, in combination with the application of pressure exerted on the mass of dry cast concrete from above. With reference to FIG. 6, the pressure is exerted by one or more plates 106, also called stripper shoes, that are brought down through the open top of the mold cavity 110 into contact with the top of the dry cast concrete in the cavity to compact the concrete. After the concrete is adequately densified, the temporarily-closed bottom of the mold cavity is reopened, the pre-cured concrete workpiece is discharged from the mold cavity through the reopened bottom of the mold cavity by lowering the pallet 102 relative to the mold while further lowering the stripper shoes 106 through the mold cavity to assist in stripping the pre-cured workpiece from the cavity. The stripper shoes 106 are then raised upward out of the mold cavity and the mold 100 is ready to repeat this production cycle. The pre-cured concrete workpiece is then transported from the mold for subsequent curing. After curing, the workpiece is split, resulting in a pair of concrete blocks.

As discussed above, in the past the work piece tended to have feathering that remained around the edges of the resulting core openings at the top of the work piece (i.e. bottom surfaces of the resulting blocks). The feathering is believed to be the result of adhesion between the dry cast concrete and the core forms that creates a ridge of concrete around the perimeter of the core opening as the workpiece is stripped from the mold. The feathering then needed to be removed, for example by a rotating brush on the production line, or manually, to enable the block to lay flat on other blocks when stacked in courses.

Figure 4A:
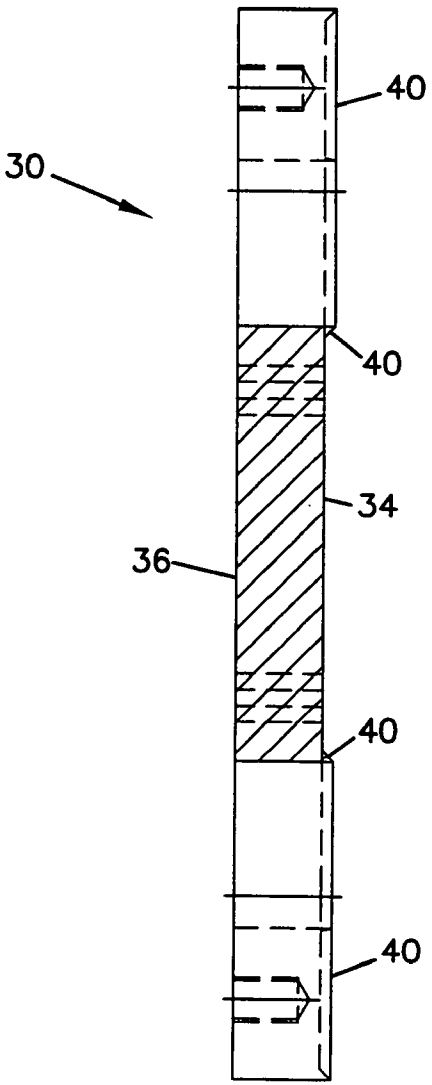
FIGS. 4A and 4B are cross-sectional views of the stripper shoes shown in FIG. 3 taken along lines 4A-4A and 4B-4B, respectively.
Figure 4B:
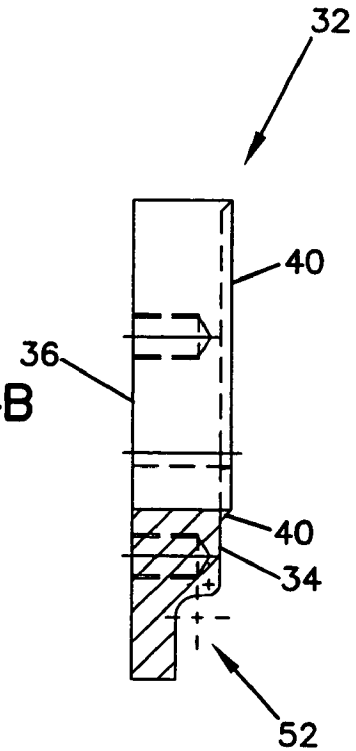

FIGS. 3 and 4A-4B illustrate stripper shoes that minimize feathering around the core openings 12 and shift any feathering that does occur to below the top surface of the work piece 28 (i.e. the bottom surfaces 16 of the resulting blocks 10). FIG. 3 illustrates a center stripper shoe 30 that is configured to compress the central portion of the workpiece during molding, and a pair of outside stripper shoes 32 that are configured to compress end regions of the workpiece during molding. The stripper shoes 30, 32 cooperate to compress the concrete in the mold cavity and to define the top surface of the work piece 28 (the bottom surfaces of the resulting blocks).

The stripper shoes 30, 32 each comprise a metal plate having a first surface 34 which in use faces toward the mold cavity and a second surface 36 opposite the first surface that faces away from the mold cavity. A plurality of core form openings 38 are formed in the shoes 30, 32. The number of openings 38 can vary based on the number of core openings 12 to be formed in the workpiece 28 and block 10. In the illustrated embodiment, two openings 38 are formed at each end of the shoe 30 and two openings 38 are formed at the end of the shoes 32 that face the respective ends of the shoe 30.

The openings 38 in the shoe 30 combine with the openings 38 in the shoe 32 to form a pair of larger openings that are each configured to allow passage therethrough of a core form 50 (a portion of which is visible in FIG. 5) that is used to form the respective core opening 12 in the concrete block 10. During molding of the workpiece and subsequent stripping from the mold, the openings 38 allow the shoes 30, 32 to move up and down relative to the core forms 50 during compression of the concrete and subsequent stripping of the work piece.

The shoes 30, 32 are spaced from each other to provide a gap 39. The gap 39 allows passage of a core bar 112, shown in FIG. 6, to which the core forms 50 are attached. The core bar 112 creates a channel 17 in the bottom surface 16 of the block as shown in FIGS. 1 and 2. The gap 39 can be, for example, about 0.5 inch wide while the core bar has a width of, for example, about 0.375 inch, which allows for a gap of about 0.0625 inch between the sides of the core bar and the stripper shoes 30, 32.

The surface 34 of each shoe 30, 32 has a beveled ridge 40 formed around the perimeter of the openings 38 and along the gaps 39 between the shoes 30, 32. The ridge 40 projects toward the mold cavity and the concrete blocks to be molded therein. FIG. 3 illustrates the ridges 40 extending around the perimeters of the openings 38 and along the gap between the shoes 30, 32, while FIGS. 4A and 4B illustrate sectional views of the ridges 40. The ridge 40 need not extend around the entire perimeter of the openings and gaps 39. Instead, the ridge 40 could extend along select portions of the openings 38 and/or gaps 39 to bevel the edges at those select portions.

Figure 5:
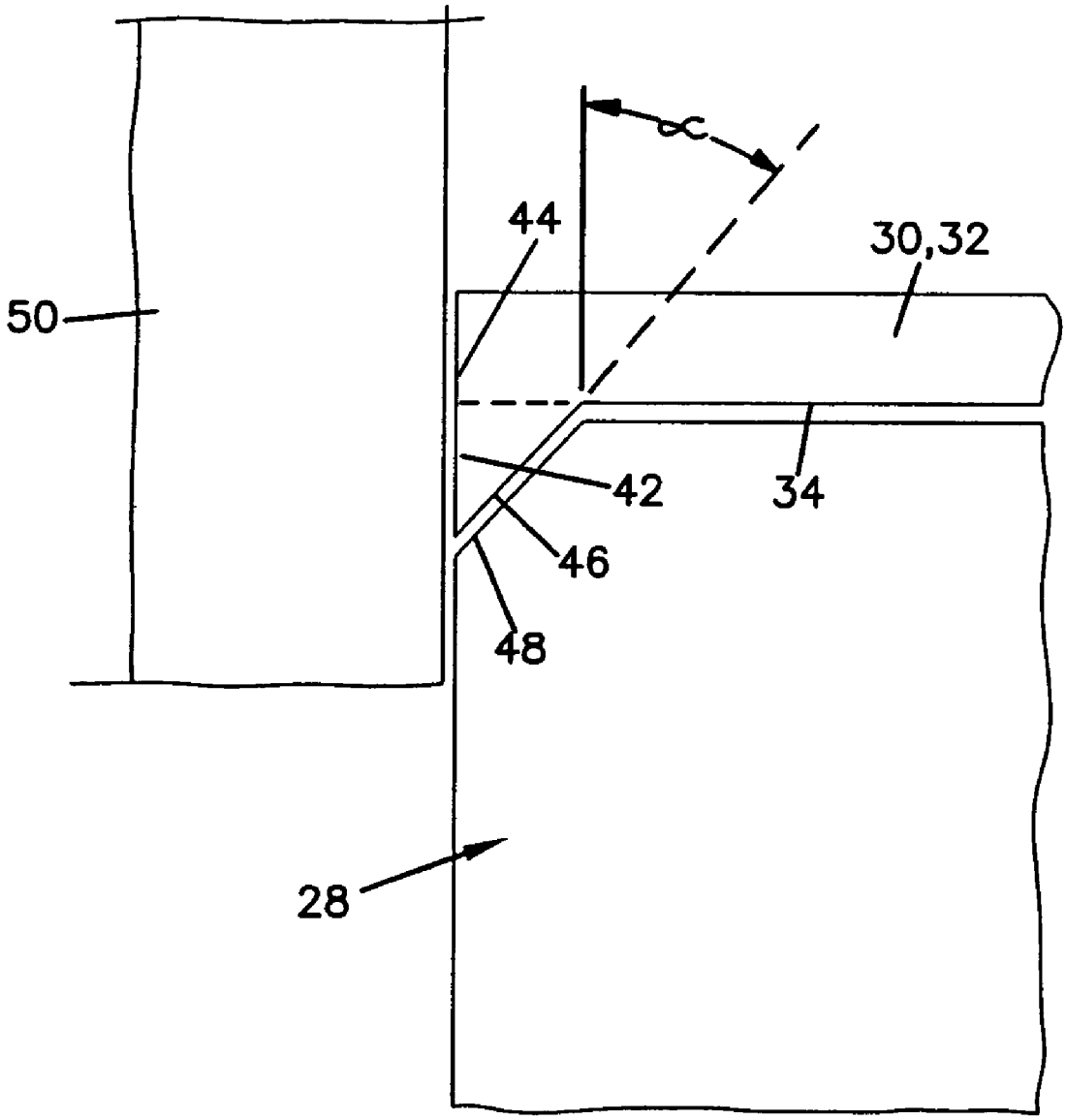
FIG. 5 is detailed view of a portion of a core form and a core form opening in a stripper shoe.

As illustrated in FIGS. 4A, 4B and 5, each ridge 40 includes a first section 42 that extends generally perpendicular to the surface 34 of the stripper shoes 30, 32 and generally parallel to, and forming an extension of, a wall 44 that forms the opening 38. Each ridge 40 also includes a second section 46 that extends from the first section 42 to the surface 34 and which is disposed at an acute angle $\alpha$ relative to the direction of travel of the core form 50 through the core form opening 38 as the work piece 28 is being stripped from the mold. For example, the angle a can be about 45 degrees. The second section 46 faces generally away from the opening 38 that it is formed around, or faces generally away from the gap 39.

As illustrated in FIGS. 3 and 4B, the surface 34 of each of the outside shoes 32 also includes a recess 52 formed therein along the entire length of the shoe 32 that results in the creation of the flange 26 on the bottom surface of the block.

With reference to FIG. 5, during molding of the workpiece 28, as the shoes 30, 32 are moved downward to compress the concrete in the mold cavity, the second section 46 of the ridge 40 creates a beveled edge 48 around the core opening that is formed by the core form 50. The ridges 40 on the shoes 30, 32 inhibit the formation of a ridge of concrete around the perimeter of the core openings. In the event that residual feathering does result, the feathering will be present on the beveled edge 48 away from the bottom surface of the block. Therefore, any residual feathering is away from the bottom surface 16 of the block and would not prevent the block from laying flat on other blocks when stacked into courses with other blocks.

Similarly, the portion of the ridges 40 that face the gaps 39 inhibits the formation of feathering along the channel 17 and/or shifts the feathering away from the bottom surface by creating a bevel along the edges of the channel 17.

Similar beveling can be provided along the bottom side edges 25 of the block where the side surfaces 22, 24 intersect the bottom surface 16. To accomplish this, a ridge (not shown) similar to the ridge 40 can be provided along the sides 54 of the mold shoes 30, 32. By providing such beveling, any residual feathering that may result from adhesion between the concrete and the side walls of the mold would be shifted away from the bottom surface 16. If the bottom side edges 25 are beveled along with the core opening edges and the channel edges, the rotating brush on the production line to sweep away feathering is unnecessary.

The invention claimed is:

1. A method of forming a dry-cast concrete block with at least one core opening therein; the method comprising the steps of:

providing a block mold having a plurality of sidewalls defining a mold cavity with an open top, an open bottom and a core form in the mold cavity at a location to form a core opening in, and extending completely through, a pre-cured concrete block formed therein;

a pallet being positioned underneath the block mold to temporarily close the open bottom of the mold cavity;

depositing dry-cast concrete in the mold cavity distributed around and against the core form and on the pallet;

introducing a plate through the open top of the mold cavity and compacting the dry-cast concrete in the mold cavity to form a pre-cured concrete block;

the plate having a first surface that, in use, faces the mold cavity and the dry-cast concrete;

the plate having a core form opening therein configured to allow passage therethrough of the core form; and, the plate including a beveled ridge on the first surface around at least a portion of the core form opening and projecting from the first surface toward the mold cavity, the beveled ridge including:

a first section that forms an extension of a wall that forms the core opening; and, a second section that extends from the first section to the first surface and which is disposed at an acute angle relative to a direction of travel of the core form through the core opening during forming of the block;

the second section facing away from the core form opening; and, the beveled ridge extending partially through the dry-cast concrete;

the step of introducing the plate and compacting the concrete including molding a beveled section in the dry-cast concrete while compacting; the beveled section being adjacent the core and the upper surface of the pre-cured block as molded;

opening the temporarily closed bottom of the mold cavity;

discharging the pre-cured concrete block from the mold cavity through the opened bottom of the mold cavity;

the step of discharging comprising lowering the pre-cured block relative to the core form until no portion of the pre-cured concrete block engages and surrounds the core form; and, the step of discharging further comprising discharging from the mold and on the pallet a pre-cured block having;

a front surface; a rear surface; side surfaces that extend from the front surface to the rear surface; a bottom surface and a top surface; and a core opening extending completely through the block from a lower surface as molded to an upper surface as molded; the core opening having a ridgeless perimeter at the portion of the core opening adjacent the upper surface as molded; and, curing the pre-cured concrete block.

2. The method of claim 1 wherein:

the step of introducing a plate comprises introducing a plate in which the acute angle of the second section is an angle of about 45°.

3. The method of claim 1 wherein:

the step of introducing a plate comprises introducing a plate in which the beveled ridge completely surrounds the core form opening.

4. The method of claim 1 wherein:

the step of providing a block mold having a core form comprises providing a block mold having two core forms, each of which is positioned and configured to form a core opening in, and extending completely through, a pre-cured block formed in the block mold; and the step of introducing a plate comprises introducing a plate having two core form openings therein; each of which has a beveled ridge extending at least partially therearound.

5. The method of claim 1 wherein:

the step of compacting including molding at least one upwardly projecting locator flange on the resulting pre-cured block at a location spaced from any core.

* * * * *